US005675948A

United States Patent [19]

Boesch

[11] Patent Number: 5,675,948

[45] Date of Patent: Oct. 14, 1997

[54] INSULATED VENTILATOR FOR GLASS BLOCK WINDOW

[75] Inventor: Steve Boesch, North Royalton, Ohio

[73] Assignee: Thermo-Vent Manufacturing, Inc., Medina, Ohio

[21] Appl. No.: 421,399

[22] Filed: Apr. 13, 1995

[51] Int. Cl.[6] ..... E06B 7/14

[52] U.S. Cl. ..... 52/209; 52/204.51; 52/204.55; 52/202; 49/501; 49/498.1

[58] Field of Search ..... 52/240.51, 204.55, 52/209, 202, 306, 307, 308; 49/501, 246, DIG. 2

[56] References Cited

U.S. PATENT DOCUMENTS

| | | | |
|---|---|---|---|
| Re. 24,077 | 10/1955 | Ensminger | 52/209 X |
| 2,667,245 | 1/1954 | Shink | 52/202 |
| 3,111,725 | 11/1963 | Brown | 52/204.51 |
| 4,023,319 | 5/1977 | Kurata . | |
| 4,084,361 | 4/1978 | Aspaas | 49/501 X |
| 4,433,517 | 2/1984 | Moore, Jr. | 52/204.55 |
| 4,447,985 | 5/1984 | Weber et al. | 49/501 X |
| 4,628,652 | 12/1986 | Wefels . | |
| 4,636,413 | 1/1987 | Wittmann et al. . | |
| 4,651,486 | 3/1987 | Erickson et al. . | |
| 4,719,735 | 1/1988 | Fleming, Jr. et al. . | |
| 4,774,793 | 10/1988 | Mayer . | |
| 4,793,104 | 12/1988 | Hultberg et al. . | |
| 4,837,977 | 6/1989 | Mauro | 49/501 |
| 4,841,696 | 6/1989 | Miller | 52/202 |
| 4,852,321 | 8/1989 | Fleming, Jr. et al. . | |
| 4,887,404 | 12/1989 | Saji et al. . | |
| 4,891,925 | 1/1990 | Carlson et al. . | |
| 4,949,506 | 8/1990 | Durham, Jr. | 52/204.51 X |
| 4,958,468 | 9/1990 | Nolan | 52/204.51 X |
| 4,959,937 | 10/1990 | Mayer . | |
| 4,974,364 | 12/1990 | Durham, Jr. | 49/501 X |
| 4,986,048 | 1/1991 | McMarlin . | |
| 5,003,747 | 4/1991 | Morton | 52/209 X |
| 5,009,048 | 4/1991 | Paul . | |
| 5,033,245 | 7/1991 | Kline . | |
| 5,038,542 | 8/1991 | Kline . | |
| 5,067,295 | 11/1991 | Francik et al. . | |
| 5,081,793 | 1/1992 | Mauro | 49/501 |
| 5,109,644 | 5/1992 | Poremba . | |
| 5,160,566 | 11/1992 | Ashby et al. . | |
| 5,187,909 | 2/1993 | Olson . | |
| 5,245,788 | 9/1993 | Riegelman | 49/498.1 X |
| 5,315,798 | 5/1994 | Zarwell | 52/202 |
| 5,333,427 | 8/1994 | Uhlik . | |
| 5,339,588 | 8/1994 | Ballstadt . | |
| 5,367,846 | 11/1994 | vonRoenn, Jr. . | |
| 5,379,560 | 1/1995 | Steller | 52/204.51 X |

FOREIGN PATENT DOCUMENTS

| | | | |
|---|---|---|---|
| 358262 | 3/1990 | European Pat. Off. | 52/209 |
| 2150187 | 6/1985 | United Kingdom | 52/204.51 |
| 2150188 | 6/1985 | United Kingdom | 52/204.51 |
| 2150189 | 6/1985 | United Kingdom | 52/204.51 |

*Primary Examiner*—Carl D. Friedman
*Assistant Examiner*—Aimee E. McTigre
*Attorney, Agent, or Firm*—Pearne, Gordon, McCoy & Granger LLP

[57] ABSTRACT

A ventilator for a glass block window is provided that has a high insulation value, is simplified in construction, and is easily repaired. The ventilator includes a unitary frame arranged to be accommodated in the glass block window and a sash for selectively closing and opening the central opening of the frame. The sash includes a unitary sash frame, an insulated glass window assembly inserted into the sash frame through an open front side of the sash frame, and spring clips which releasably retain the window assembly within the sash frame. The frame, the sash frame, and the spring clips are each vinyl extrusions. The ventilator also includes a bubble seal at an interface between the frame and the sash frame when the sash is closing the central opening of the frame. The seal is integral with the sash frame and preferably is coextruded with the extrusions of the sash frame. Hinge members are provided to articulate the sash between closed and ventilating positions and a latch is provided to lock the sash in the closed position.

10 Claims, 3 Drawing Sheets

INSULATED VENTILATOR FOR GLASS BLOCK WINDOW

BACKGROUND OF THE INVENTION

1. Field of the Invention

The present invention relates in general to ventilators for glass block windows and, more particularly, to an insulated ventilator having an improved sash.

2. Description of Related Art

Combined window and vent units for glass block windows and the advantages attendant to their use are known in the art, as exemplified by U.S. Pat. No. 5,315,798, the disclosure of which is expressly incorporated herein by reference in its entirety. This patent discloses a combined window and vent unit having a window panel movable within a frame without the use of hinges. A second window panel is fixed to the frame with screws to provide additional insulation.

Other combined window and vent units for glass block windows have a window sash hinged to a frame. The window sash typically has a sash frame formed by extrusions which are held together by screws. The extrusions have grooves which hold one or two window panes. To replace the window panes, the extrusions must be disassembled so that the window panes can be slid into the grooves. The disassembly of the extrusions requires removal of screws. Other sash frames are formed by bonding or welding extrusions together. Such sash frames must be completely replaced if the window panes become damaged.

It is a goal of the present invention to improve the insulation value of ventilators for glass block windows. By improving the insulation value of the ventilators, the ventilators become more desirable to home owners in climates where heat loss is a concern. It is also a goal of the present invention to simplify the construction of ventilators for glass block windows and to simplify the replacement of window panes. By simplifying the construction of the ventilator, the total number of parts required can be reduced and the ease of assembly can be improved, thereby reducing the cost of manufacture.

SUMMARY OF THE INVENTION

In accordance with the present invention, a ventilator for a glass block window is provided that overcomes the above-noted problems of the related art. The ventilator includes a frame arranged to be accommodated in the glass block window and forming a central opening and a sash for selectively closing the central opening in a closed position and opening the central opening in a ventilating position. The sash including a sash frame and a sealed double-pane window assembly within said sash frame. The ventilator also includes a seal at an interface between the frame and the sash frame when the sash is in the closed position and means for holding said sash in the closed position and the ventilating position.

In a preferred embodiment, spring clips are provided for releasably retaining the window assembly within the sash frame. The spring clips are vinyl extrusions having resilient legs which are snapped into and out of recesses of the sash frame.

In another preferred embodiment, the seal is a bubble seal integral with the sash frame. The seal is coextruded with extrusions of the sash frame.

In yet another preferred embodiment, the sash frame is open on a front side for inserting and removing the window assembly. Fastenerless retainers or spring clips are adapted to partially close the open front side to releasably secure the window assembly within the sash frame.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
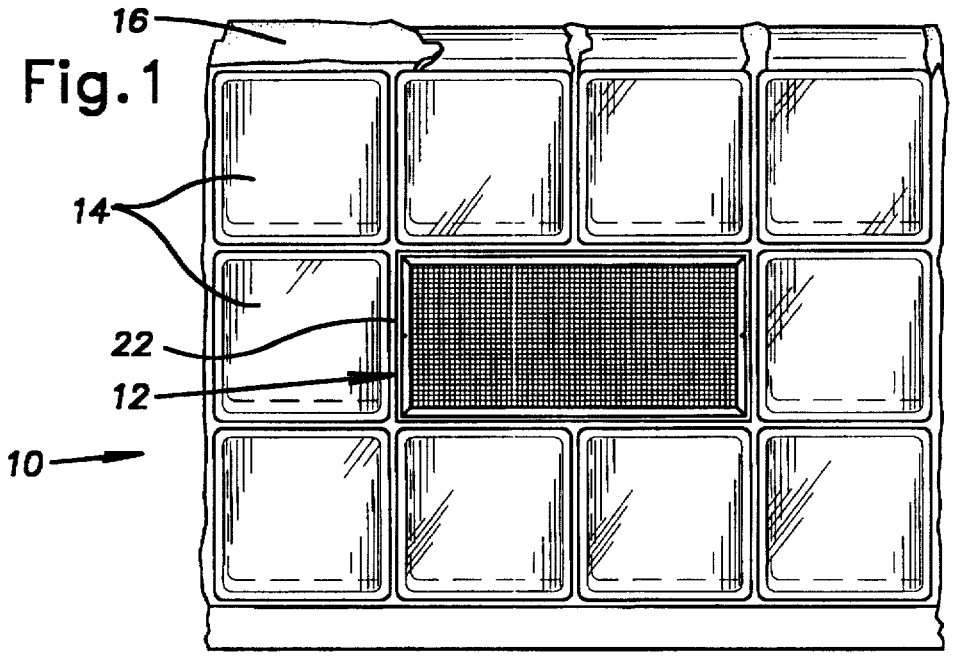
FIG. 1 is a perspective outside or back view of a portion of a glass block window having an insulated ventilator according to the present invention.

FIG. 1 illustrates a glass block window 10 having an insulated ventilator 12 according to the invention. The window 10 includes a plurality of glass blocks 14 of generally rectangular configuration. The glass blocks 14 are joined along adjacent abutting surfaces by a suitable material 16 such as, for example, mortar or an adhesive material. The ventilator 12 is also joined to adjacent glass blocks 14 along abutting surfaces by the bonding material 16.

Figure 2:
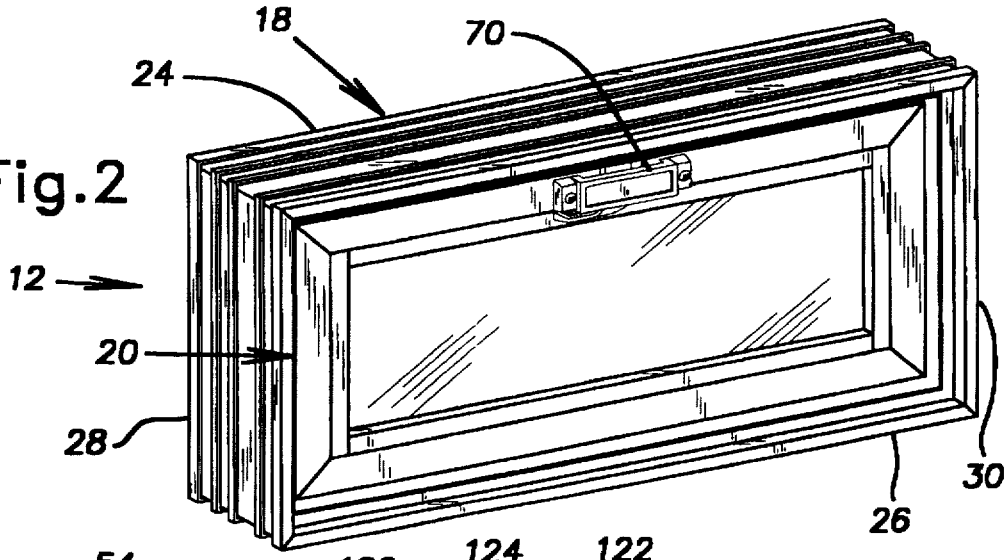
FIG. 2 is a prospective front view of an insulated ventilator according to the present invention.

As best shown in FIG. 2, the ventilator 12 includes a frame 18, a sash 20 on a front side of the ventilator 12, and a screen assembly 22 (FIG. 1) on a back side of the ventilator 12. The frame 18 is rectangularly-shaped with upper and lower horizontal portions 24, 26 and left and right vertical portions 28, 30, each having a similar cross section. The frame portions 24, 26, 28, 30 are preferably individually extrusion molded and welded together with miterd corners to form a unitary frame having a central opening. The frame 18 can be formed from any suitable material such as, for example, vinyl.

Figure 4:
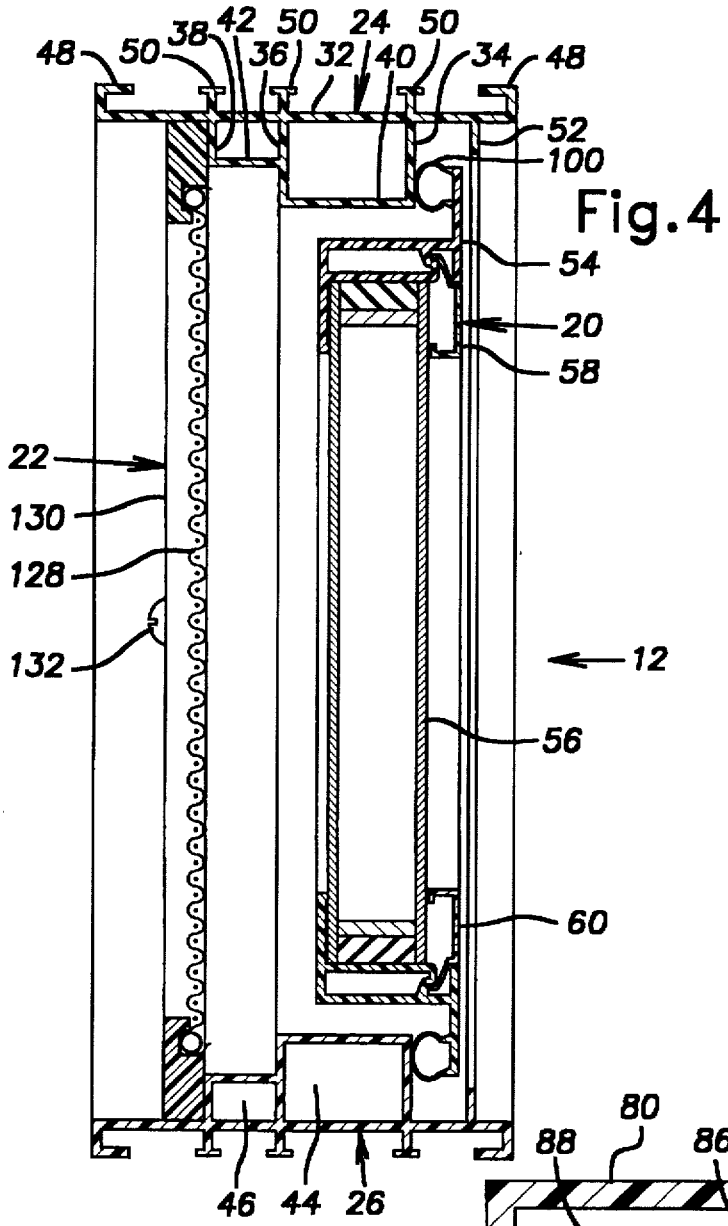
FIG. 4 is an enlarged elevational view of the insulated ventilator, in cross-section, taken along lines 4—4 of FIG. 3.

As best shown in FIG. 4, the frame portions 24, 26, 28, 30 each include a generally planar base wall 32. First second, and third support walls 34, 36, 38 perpendicularly extend from an inner surface of the base wall 32 and first and second connecting walls 40, 42 extend perpendicular to the base wall 32 between inner ends of the support walls 34, 36, 38 to form first and second hollow sections 44, 46. The hollow sections 44, 46 are both generally rectangularly-shaped but the first hollow section 44 is relatively taller and wider than the second hollow section 46. The first support wall 34 is sized to provide an engagement surface, for the sash 20, and the third support wall 38 is sixed to provide an engagement surface for the screen assembly 22 as further described hereinafter.

A generally L-shaped bonding wall 48 extends from an outer surface of the base wall 32 at each end of the base wall 32. Generally T-shaped bonding walls 50 extend from the outer side of the base wall 32 opposite the support walls 34, 36, 38. The bonding walls 48, 50 and the base wall 32 form corings which assure an effective bond of the bonding material 16 (FIG. 1) to the frame 18. A latch wall 52 perpendicularly extends from the inner surface of the base wall 32 near the front end of the base wall 32.

Figure 3:
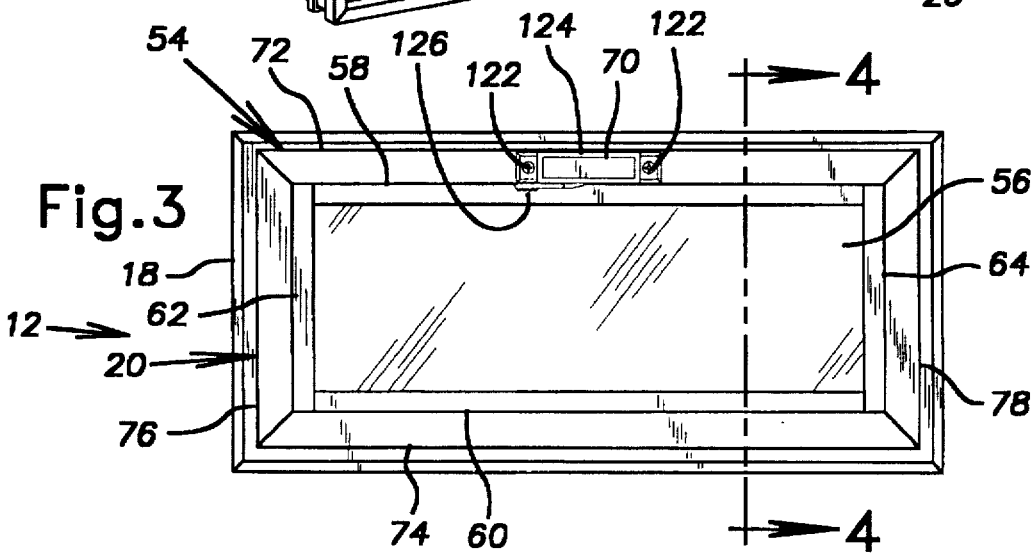
FIG. 3 is a front elevational view of the insulated ventilator of FIG. 2.

The sash 20 includes a frame 54, an insulated glass window assembly 56, spring clips or retainers 58, 60, 62, 64, hinge members 66, 68, (FIG. 6) and a latch 70 (FIGS. 1 and 2). As best shown in FIG. 3, the sash frame 54 is rectangularly-shaped with upper and lower horizontal portions 72, 74 and left and right vertical portions 76, 78, each having a similar cross section. The sash frame portions 72, 74, 76, 78 are preferably individually extrusion molded and welded together with miterd corners to form a unitary sash frame 54 with a central opening. The sash frame 54 can be formed from any suitable material such as, for example, vinyl.

Figure 5:
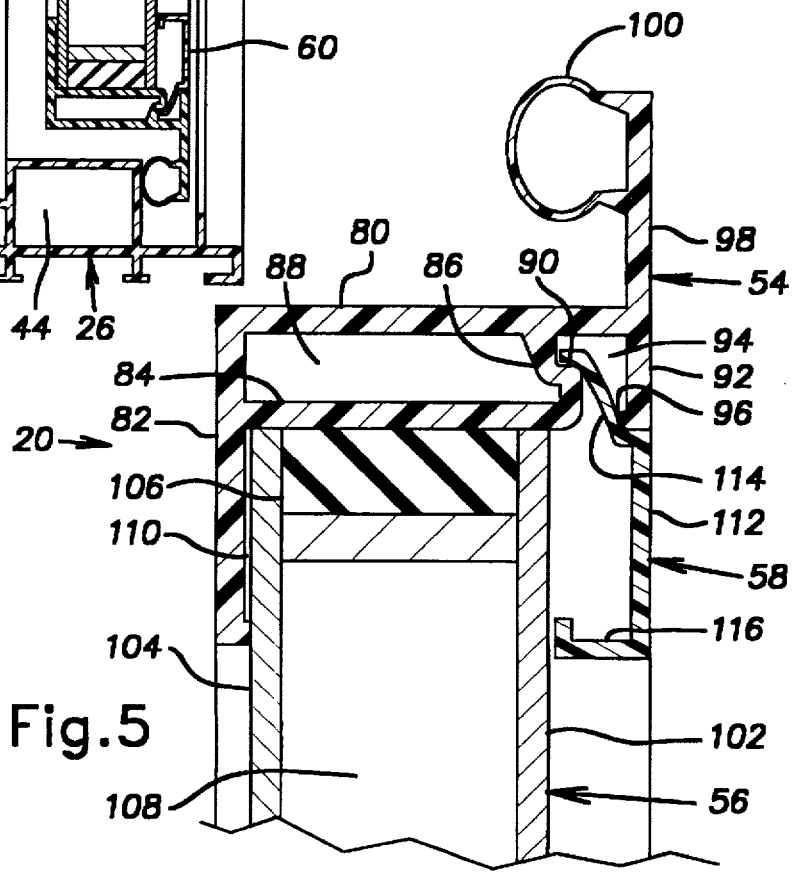
FIG. 5 is an enlarged fragmented view, in cross-section, of the insulated ventilator of FIG. 4 in the area of the sash frame.

Each of the sash frame portions 72, 74, 76, 78 include a generally planar main wall 80 and a back wall 82 perpendicularly extending from an inner surface of the main wall 80 at the back end of the main wall 80 to form a seat or recess for the window assembly 56. As best shown in FIG. 5, a support wall 84 perpendicularly extends from a front surface of the back wall 82 and parallel to the main wall 80. A first retaining wall 86 connects a front end of the support wall 84 to the main wall 80 to form a generally rectangularly-shaped hollow section 88. The first retaining wall 86 includes a notch which forms an engagement surface 90 which is generally perpendicular to and facing the main wall 80 on the front surface of the first retaining wall 86. A second retaining wall 92 perpendicularly extends from an inner surface of the main wall 80 at the front end of the main wall 80. The second retaining wall 92 is generally parallel to and offset from the first retaining wall 86 to form a retaining recess 94. A protrusion 96 rearwardly extends from a back surface of the second retaining wall 92 at an inner end of the second retaining wall 92.

A seal wall 98 perpendicularly extends from the front end of the main wall 80 opposite the second retaining wall 92. A bulb or bubble-type weather strip or seal 100 extends from an inside surface of the seal wall 98 at an outer end of the seal wall 98. The seal 100 is generally hollow and has a relatively thin wall thickness compared to the other walls of the sash frame 54. The seal 100 is preferably coextruded having a different hardness (durometer) than the remainder of the sash frame 54 so that the seal 100 is resiliently deformable while the remainder of the sash frame 54 is relatively rigid.

The insulated glass window assembly 56 includes front and back spaced-apart window panes or glazings 102, 104. Retaining and sealing elements 106 extend around the entire periphery of the inner surfaces of the window panes 102, 104 to space apart, retain, and seal the window panes 102, 104 together in a unitary assembly 56. A hermetically sealed interior space 108 is formed between the window panes 102, 104. The insulated glass window assembly 56 can be constructed in a known manner such as a Thermopane™ window. The sealed interior space 108 is evacuated, or filled with a suitable gas, to improve the insulating characteristics of the insulated glass window assembly 56. The insulating value of an insulated glass window assembly is approximately twice that of an ordinary unsealed multiple-pane window assembly. While the illustrated insulated glass window assembly 56 is a double-paned window assembly, it is noted that the window assembly could have three or more spaced-apart panes of glass.

The window assembly 56 is sized to fit within the sash frame 54 and has a thickness that fits between the back wall 82 and the first retaining wall 86. Preferably, a glazing bead 110 such as, for example, a bead of silicone, is provided between the back window pane 104 of the window assembly 56 and the back wall 82 of the sash frame 54. The window panes 102, 104 can be of any suitable material such as, for example glass or plastic, and can be either transparent or obscure.

As best shown in FIG. 3, upper, lower, left and right spring clips or retainers 58, 60, 62, 64 are provided to hold the window assembly 54 within the sash frame 54. The retainers 58, 60, 62, 64 are preferably extrusions having similar cross sections adapted to cooperate with the sash frame 54. The retainers 58, 60, 62, 64 of the illustrated embodiment extend around the entire periphery of the window assembly 56. The retainers 58, 60, 62, 64 have a main wall 112 generally parallel to and extending from the second retaining wall 92 of the sash frame 54 and first and second engagement walls 114, 116 extending from opposite ends of the main wall 112. As best seen in FIG. 5, the first engagement wall 114 is generally S-shaped having two leg portions and a connecting portion. The first engagement wall 114 is adapted to resiliently snap into the retaining recess 94 of the sash frame 54 and engage the first and second retaining walls 86, 92 of the sash frame 54. One leg portion engages the engagement surface 90 and the other leg engages the protrusion 96 to prevent lateral movement. The connecting portion engages the protrusion to prevent forward movement. The second engagement wall 116 is generally L-shaped having a leg portion and a connecting portion. The leg portion engages the front pane 102 of the window assembly 56 preventing backward movement. The retainers 58, 60, 62, 64 thereby hold window assembly 56 within the sash frame 54. It is noted that the retainers 58, 60, 62, 64 could have other geometries or quantities effective to removably retain the window assembly 56 within the frame 18. The retainers 58, 60, 62, 64 can be formed from any suitable material such as, for example vinyl.

Figure 6:
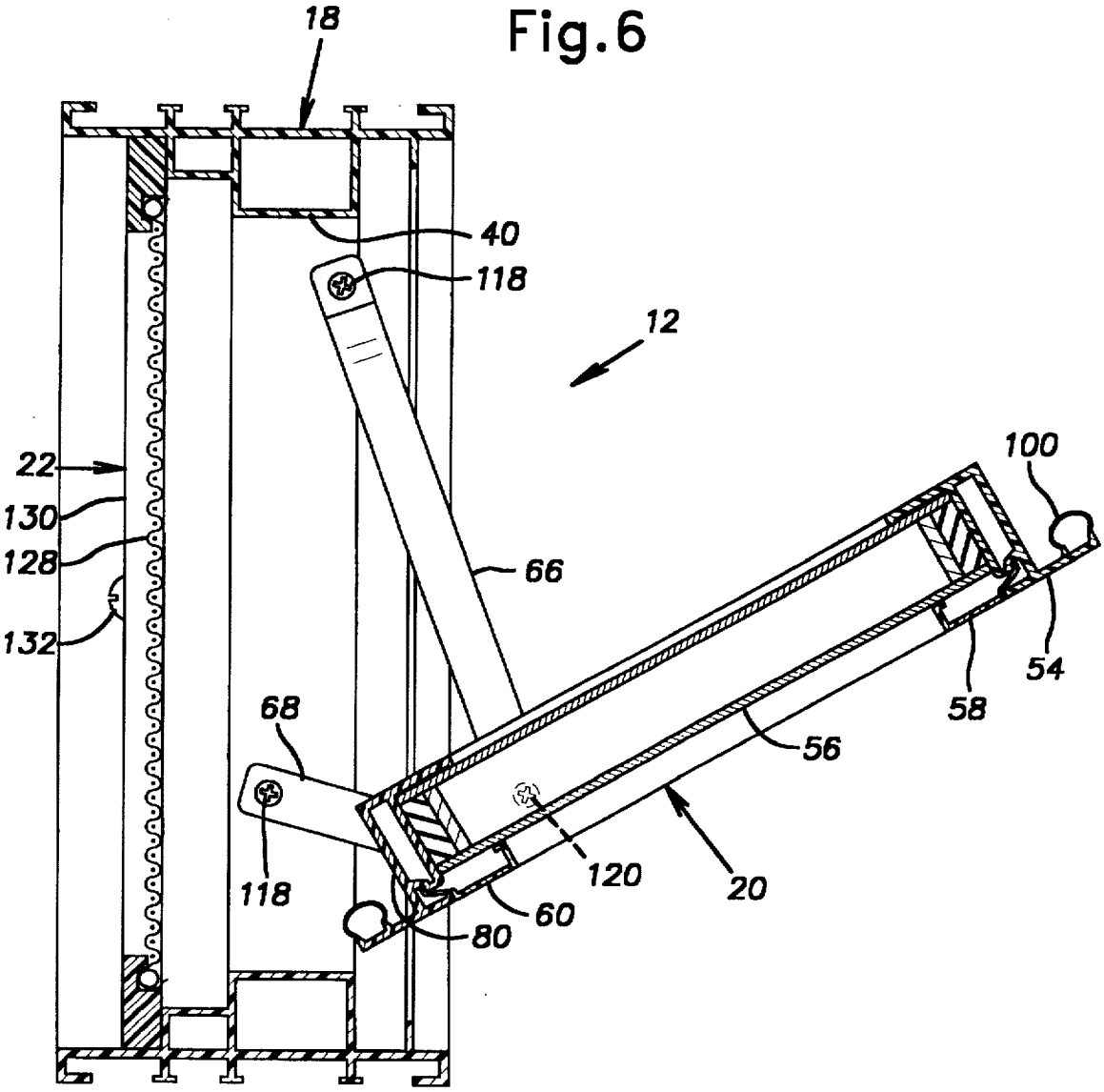
FIG. 6 is a is an elevational view, in cross-section, of the insulated ventilator similar to FIG. 4 but with the sash in an open position.

A best shown in FIG. 6, a pair of upper and lower hinge members 66, 68 are provided at each side of the sash 20 to attach the sash 20 to the frame 18. One end of each of the hinge members 66, 68 is attached to the first connecting wall 40 of the frame 18 by a suitable fastening means 118 such as, for example, a stainless steel screw. The other end of each of the hinge members 66, 68 is attached to the main wall 80 of the sash frame 56 by a suitable fastening means 120 such as, for example, a stainless steel screw. The hinge members 66, 68 are sized and located such that the sash 20 articulates from a closed position (as shown in FIG. 4) to an open position (as shown in FIG. 6). In the closed position, the seal 100 of the sash frame 54 sealably engages the first support wall 34 of the frame 18 to sealingly close off the central opening in the frame 18. In the open position, the sash 20 is inclined and away from the central opening in the frame 18 to provide ventilation through the glass block window 10 (FIG. 1). It is noted that other types of hinge members could be utilized such as, for example, scissor-type hinges or compression-type hinges.

As best shown in FIGS. 2 and 3, the latch 70 is attached to the upper portion 72 of the sash frame 54 by suitable fastening means 122 such as, for example, stainless steel screws. The latch 70 includes a hand actuated lever 124 for rotating a biased projection 126. The projection 126 is received behind the latch wall 52 (FIG. 4) of the frame 18 to secure or lock the sash 20 in the closed position. It is noted that latches of other types can be utilized such as, for example, a spring-type latch.

As best seen in FIG. 4, the screen assembly 22 includes a screen member 128 secured to a rectangularly shaped screen frame 130 in a known manner. The screen frame 130 is sized and shaped to fit within the central opening of the ventilator frame 18 and to engage the third support wall 38 of the ventilator frame 18. The screen frame 130 is attached to the third support wall 38 of the ventilator frame 18 by suitable fastening means 132 such as, for example, stainless steel screws. The screen member 128 is formed from any suitable material such as, for example, fiberglass screening. The screen frame 130 is formed from any suitable material such as, for example, vinyl or aluminum.

To replace the window assembly 56, the retainers 58, 60, 62, 64 are each in turn pushed inwardly along the outer surface of the front window pane 102 until the first engagement wall 114 resiliently deflects so that the leg passes over the notch and out of engagement with the engagement surface 90 of the sash frame first retaining wall 86. With the retainers 58, 60, 62, 64 removed, the window assembly 56 easily can be removed from the sash frame 54 through the front opening. Once a new window assembly 56 is inserted into the sash frame 54 through the front opening, each of the retainers 58, 60, 62, 64 are in turn pushed outwardly along the outer surface of the front window pane 102 until the first engagement wall 114 deflects so that the leg passes into the recess and resiliently returns to its normal form in the notch where it is in engagement with the engagement surface 90 of the sash frame first retaining wall 86. It can be seen from the above description that the window assembly 56 can be easily removed and replaced without the use of mechanical fasteners.

Although particular embodiments of the invention have been described in detail, it will be understood that the invention is not limited correspondingly in scope, but includes all changes and modifications coming within the spirit and terms of the claims appended hereto.

What is claimed is:

1. A window ventilator comprising:

a frame forming a central opening;

a sash including a sash frame, a window assembly within said sash frame, and a spring clip, said sash frame including a pair of spaced apart walls, said spring clip having a resilient portion releasably retained between said walls and another portion adapted to engage and retain said window assembly within said sash frame, said sash being movable between a closed position wherein said central opening is closed and a ventilating position wherein said central opening is open;

a seal at an interface between said frame and said sash frame when said sash is in said closed position; and hinge members connecting said sash to said frame for articulating said sash between said closed position and said ventilating position.

2. The ventilator according to claim 1, wherein said sash frame is rectangularly-shaped with upper, lower, left and right portions of unitary construction, at least one spring clip being located at each of said portions.

3. The ventilator according to claim 1, wherein said spring clip is an extrusion.

4. The ventilator according to claim 1, wherein said spring clip is formed from vinyl.

5. The ventilator according to claim 1, wherein said sash frame has a recess and said spring clip has a resilient leg adapted to snap into and out of said recess.

6. The ventilator according to claim 5, wherein said resilient leg is generally S-shaped.

7. The ventilator according to claim 1, wherein said seal is a bubble seal integral with the sash frame.

8. The ventilator according to claim 7, wherein said seal is coextruded with extrusions of said sash frame.

9. The ventilator according to claim 1, wherein said window assembly has at least two spaced apart window panes.

10. The ventilator according to claim 9, wherein said window assembly has means for forming a hermetically sealed space between said at least two window panes.

* * * * *